United States Patent [19]

Bochan

[11] 4,440,004

[45] Apr. 3, 1984

[54] WOBBLE WASHER

[75] Inventor: John Bochan, Louisville, Ky.

[73] Assignee: General Electric Company, Louisville, Ky.

[21] Appl. No.: 288,958

[22] Filed: Jul. 31, 1981

[51] Int. Cl.[3] ..... D06F 23/04

[52] U.S. Cl. ..... 68/23 R; 68/171; 74/63; 74/86

[58] Field of Search ..... 74/86, 63; 192/415, 192/12 BA; 188/77 W, 82.6; 464/112, 113, 119, 123; 68/23 R, 171, 172, 173, 174, 133

[56] References Cited

U.S. PATENT DOCUMENTS

| | | | |
|---|---|---|---|
| 2,432,766 | 12/1947 | Kirby | 68/19 |
| 2,549,824 | 4/1951 | Kost | 68/172 |
| 2,555,400 | 6/1951 | DeRemer | 68/23 |
| 2,921,459 | 1/1960 | Long | 68/171 |
| 3,263,459 | 8/1966 | Bochan et al. | 68/23 |
| 4,329,859 | 5/1982 | Roberts | 68/23 R |

FOREIGN PATENT DOCUMENTS 151477 5/1953 Australia .

*Primary Examiner*—Philip R. Coe

*Attorney, Agent, or Firm*—H. Neil Houser; Radford M. Reams

[57] ABSTRACT

A vertical axis flow through type clothes washing machine with a basket driving transmission which imparts a wobble action to the basket during wash and conventional rotational motion during spin operations. The transmission supports the basket such that when the input drive shaft rotates in its wash direction, the central basket axis is canted relative to the substantially vertical axis of rotation of the drive shaft. As the shaft rotates, the central basket axis describes an inverted cone thereby imparting the wobble action to the basket which is prevented from rotating about its own axis. When the drive shaft rotates in the opposite direction for spin, the central axis of the basket is substantially coaligned with the vertical axis of rotation of the input drive shaft, and the basket is rotated about its own axis for centrifugal extraction of liquid from the clothes in the basket.

9 Claims, 3 Drawing Figures

WOBBLE WASHER

BACKGROUND THE INVENTION

The present invention relates to a washing machine for the washing of fabric articles such as clothes, and more particularly to a washing machine of the "wobble" type. The wobble washer essentially uses a unitary basket which is wobbled to cause relative motion between the liquid and the fabrics contained therein.

U.S. Pat. No. 2,555,400 to De Remer discloses a wobble type of washing machine having a basket mounted to a rotor shaft which is coupled to the input drive shaft by a universal joint. The weight of the clothes and liquid in the basket causes the shaft to tilt and rest against inverted conical walls of a gyrator which then moves the rotor shaft in a conical path so that the axis of the basket describes an inverted cone having an apex beneath the basket. The rotor shaft is moved toward a vertical position by a combination of spring forces and gyroscopic forces for the spin mode of operation.

Other examples of wobble type machines include that shown in U.S. Pat. No. 2,549,824 to Kost where the tub axis is made to wobble in a conical path while the tub is oscillated about its own axis. The washing motion is accomplished by an inclined post and a ball pivot extended into a cocked off-center bearing in a worm wheel. An attached slide link provides angular displacement of the post about its axis. U.S. Pat. No. 3,263,459 to Bochan et al, shows a basket eccentrically mounted on the upper end of the drive shaft which extends upwardly within the tub. During wash, the drive shaft rotates while a clutch mechanism prevents rotation of the basket. The rotation of the drive shaft thus imparts a wobble motion to the basket and the fabric articles contained therein. The basket remains canted during spin. Finally, U.S. Pat. No. 2,432,766 to Kirby describes a washing machine in which the basket executes an orbital movement while at the same time being rotated about its own axis. Although the degree of gyration appears to be much less than in a true wobble type washer, the motion is still of a wobble type.

In order to minimize stresses on the support suspension system for the basket, as well as to minimize vibration during spin, it is desirable to center the basket during spin to permit rotation about its own axis. Of the wobble type machines hereinbefore referred to, only the De Remer machine makes provision for centering the basket for spin. Even in De Remer, the spin typically is somewhat off center, causing its axis to precess as it relies on gyroscopic forces balanced by spring forces for centering during spin. It is desirable to correct this deficiency in the art by providing a simple relatively inexpensive mechanism for wobble washers which would cant the basket to provide wobble motion during wash cycles and reliably center the basket for rotation about its own axis during spin cycles.

It is therefore an object of the present invention to provide a washing machine of the wobble type with a mounting arrangement which provides wobble motion of the basket during wash periods and vertically aligns and centers the basket for spin about its own axis during spin periods.

It is a further object of the present invention to provide a mounting structure for a washing machine of the wobble type which cants the central axis of the wash basket relative to a substantially vertical reference axis during wash periods to impart a wobble motion to the basket as the drive shaft rotates in one direction, and aligns the central basket axis with the reference axis during spin periods for rotation of the basket about its own axis when the drive shaft rotates in the opposite direction.

SUMMARY OF THE INVENTION

In accordance with an illustrative embodiment of the present invention, there is provided a washing machine of the fresh water, vertical axis type, having a dynamic system including a single perforate wash basket having a longitudinal central axis. The basket is movably supported and selectively driven by mounting means including input drive shaft means driven by a reversible electric motor. The axis of rotation of the input drive shaft means defines a substantially vertical reference axis. The input drive shaft means is selectively rotated in a first direction to provide wash periods of operation and in the opposite direction to provide spin periods of operation. The mounting means is constructed and arranged to cant the central axis of the basket relative to the reference axis when the input shaft is rotated in its first direction such that movement of the central basket axis describes an inverted cone with its apex intersecting the vertical reference axis, thereby imparting a wobble action to the non-rotating wash basket, and to substantially coalign the central axis of the basket with the reference axis when the shaft is rotated in its second direction, such that the basket rotates with the shaft means about its own central axis.

In one form of the invention the mounting means primarily comprises three nested rotary members, an input drive tube, an intermediate drive shaft and an output drive sleeve. The input drive tube is driven by a reversible electric motor, the axis of rotation of the tube defining a substantially vertical reference axis. The basket is securely mounted to the output drive sleeve. The input drive tube is mechanically coupled to the output drive sleeve by the rigid intermediate drive shaft comprising a first shaft portion rotatably received in the drive tube bore and a second shaft portion canted relative to the first shaft portion rotatably received in the sleeve bore. The drive tube bore and the drive sleeve bore are canted relative to the reference axis and basket axis, respectively. The angle formed intermediate the first and second portions of the intermediate shaft are such that when the drive tube and intermediate shaft are in a first relative position, the first shaft portion of the intermediate shaft supports the basket with the basket axis canted relative to the reference axis and when the tube and intermediate shaft are in the second relative position the first shaft portion of the intermediate shaft supports the basket in an upright position with its central axis substantially coaligned with the reference axis. Lost motion coupling means linking the drive tube to the intermediate drive shaft permits movement between the first and second relative positions when the electric motor changes its direction of rotation.

DETAILED DESCRIPTION OF THE INVENTION

Figure 1:
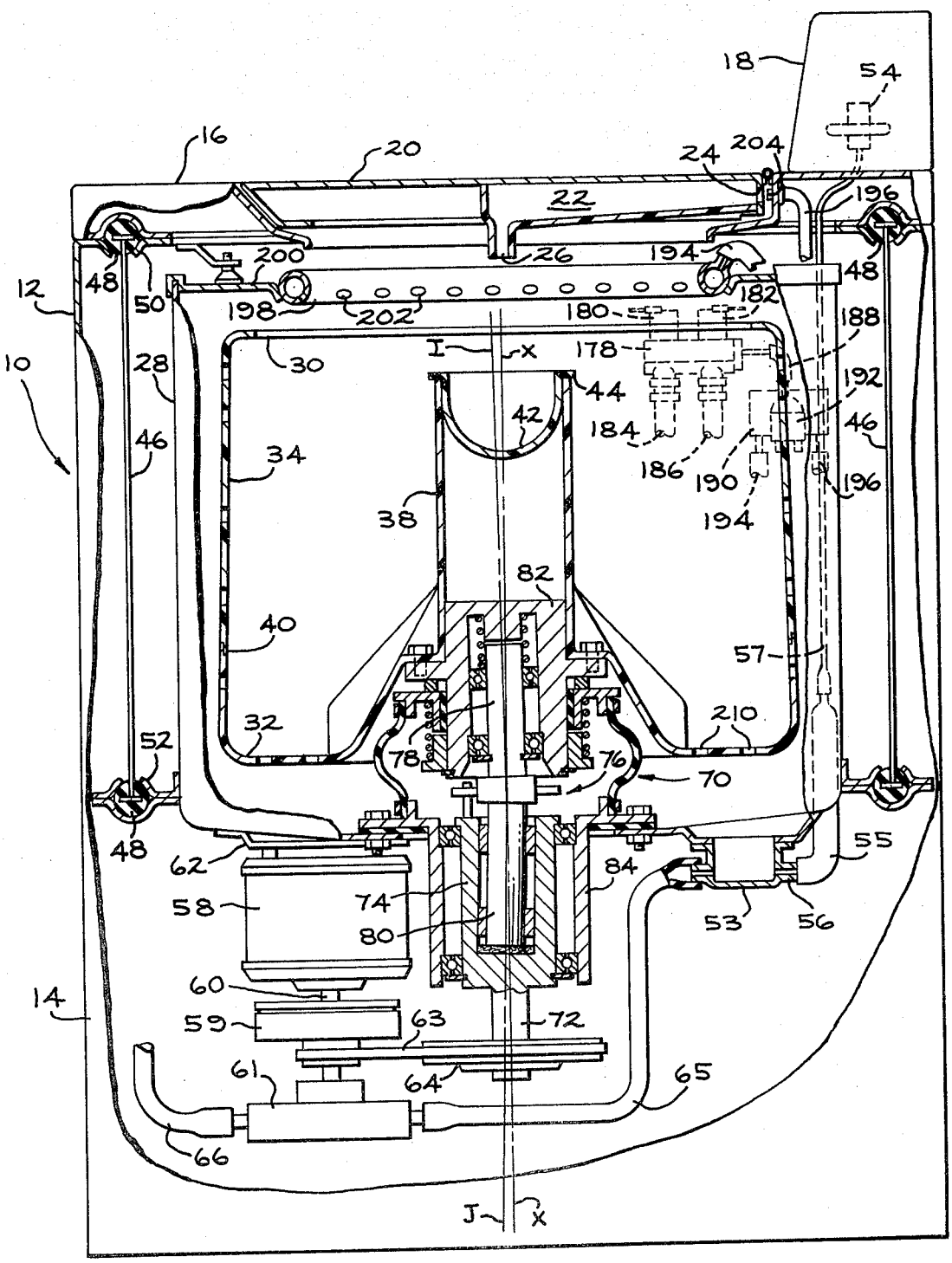
FIG. 1 is a side elevational view, partly in section, of a washing machine in accordance with one embodiment of the present invention showing the basket in position for spin.

In accordance with the present invention and referring to FIG. 1, there is shown a washing machine 10 of the vertical axis type which includes a cabinet 12 having a base portion 14 and a top 16. Such a machine may be supplied with levelling legs for adjusting and levelling the machine to various floor surfaces. They have been omitted for the sake of simplicity. Cabinet top 16 includes a control panel 18 normally provided with a plurality of switches and controls for user control of the operation of the machine.

Cabinet top 16 also is provided with an access lid 20 hinged for movement between a closed position as shown and an open position permitting access to the interior of the washing machine. Lid 20 is provided with a water receiving trough or compartment 22 having a fluid inlet aperture 24 and a discharge spout 26.

Within the cabinet is disposed an imperforate stationary tub or casing 28. Within the imperforate tub 28 there is disposed a basket or receptacle 30 for receiving fabric articles, such as clothing, to be washed. The basket 30 is intended to be of relatively light weight and may be molded, for example, from a plastic material such as polypropylene. In the particular form shown the basket is of a two-piece construction and includes a bottom 32 and a body 34. The bottom 32 and body 34 are formed with interengaging shoulders, indicated at 40, for connecting the two parts into a unitary basket. Any conventional process and material may be utilized to join the interengaging shoulder for uniting the two parts of the basket; for example, when the basket is formed of polypropylene a preformed ribbon containing polypropylene and stainless steel particles can be placed between the shoulders and induction heated to form the bond. The material, process and equipment for this type of operation are marketed under the name "Emabond."

Basket 30 includes a center post 38 extending upwardly from the bottom of the basket at the central portion thereof. Center post 38 has a cup-shaped receptacle 42 press-fitted therein, with an annular rim 44 of receptacle 42 engaging the upwardly extending cylindrical walls of center post 38. Receptacle 42 is adapted to receive and dispense detergent and/or other wash additives during portions of the wash cycle when water is supplied to receptacle 42 from spout 26.

Tub 28 is suspendedly mounted to the cabinet 12 by three rods 46 which are fixed to resilient spherical members 48. The spherical members are in turn secured to sockets 50 formed in cabinet 12 and in a retaining support member 52 attached to the tub 28, respectively. Only two rod and socket combinations are fully shown in FIG. 1, but it will be understood the other rod and socket combination is identical. The rod and socket combinations are spaced 90° apart around the tub 28 and disposed in three of the corners of the machine cabinet 12.

A sump 53 is secured in an opening of the bottom of tub 28 to receive washing liquid flowing from basket 30. A water level switch 54 which may be of the type well known in the art is mounted in a control panel 18. An air chamber 55 is connected to nipple 56 of sump 53 and a hose 57 connects air chamber 55 to switch 54. As water accumulates in sump 53 the air in chamber 55 is compressed and switch 54 is closed.

Basket 30 is driven through a combination mounting and driving means designated generally 70 including input drive shaft 72 by a reversible electric motor 58. Motor 58 is suitably mounted to tub 28 by mounting member 62. A suitable load limiting clutch 59 is mounted on the motor shaft 60 of the motor 58. A suitable belt 63 transmits power from clutch 59 to the input shaft 72 of mounting and driving means 70 through a pulley 64. Shaft 60 also supports and drives pump 61 as is customary in the art.

Pump 61 is connected to sump 53 by a hose 65 for withdrawing water from tub 28. Pump 61 is formed so that in either direction of motor rotation pump 61 will draw liquid from sump 53 through hose 65 and discharge it through hose 66 to a suitable drain (not shown). The particular form of the pump assembly 61 is not significant so long as the pump withdraws liquid from the tub in response to motor rotation in either direction. It should be noted that with use of the suspension system as shown and described the motor 58, clutch 59, mounting and driving means 70, tub 28, and basket 30 are all suspended and supported from the cabinet 12 by rods 46. Although the rod type suspension is shown, it should be understood that several other suspension systems may be used provided the tub and working components are incoporated in the moving system as described above. That is, since the tub and structure it supports provides the inertial resistance against which the basket acts when wobbling and also provides an unbalance excursion limiting mass during basket spin, the suspension system should accommodate the wobble and spin motion with minimum force transmission to the supporting cabinet. The tub and other suspended working components should be suspended so as to limit any secondary induced motion due to the unbalanced mass of the moving basket so as not to adversely affect the wobbling motion of the basket.

Figure 3:
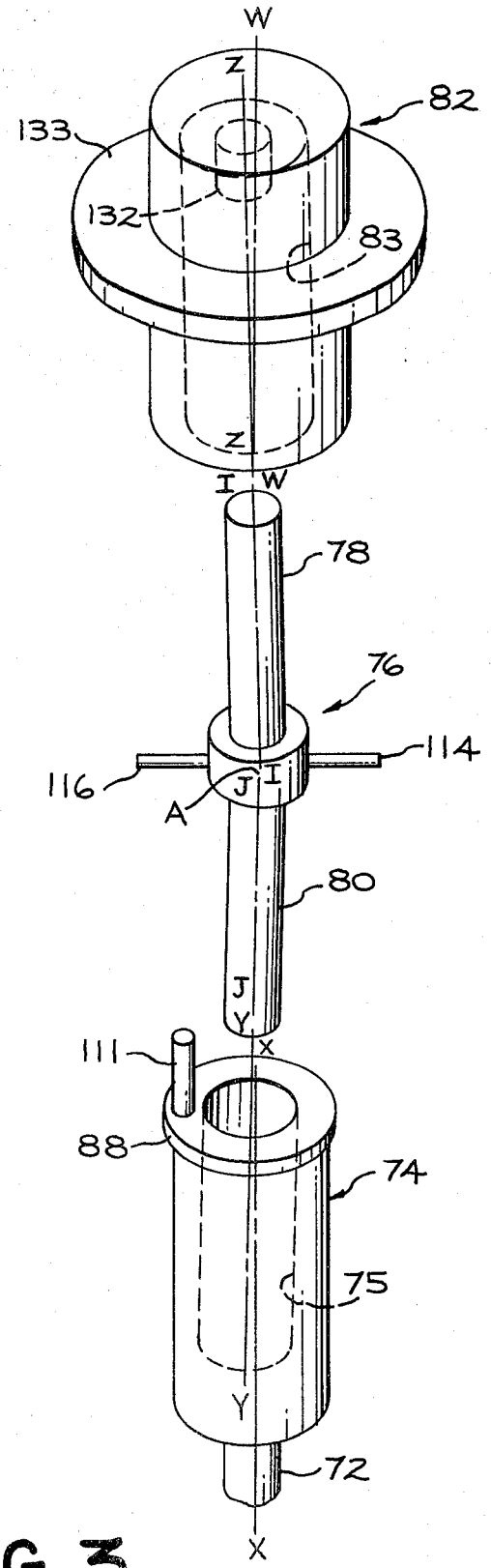
FIG. 3 is an exploded perspective view of the input drive tube, intermediate drive shaft and output drive sleeve of the washing machine of FIG. 1.

Basket 30 is supported by mounting and driving means 70 for both a wobble type motion and for a spin or centrifugal extraction type motion. As best seen in FIG. 3, to this end the basket mounting means 70 comprises three primary rotary drive elements; an input drive means comprising an input shaft 72 with an enlarged drive tube portion 74 extending therefrom, an intermediate drive shaft 76 comprising a first or upper shaft portion 78 and a second or lower shaft portion 80 formed at an angle relative to the first or upper portion and an output drive sleeve 82. The three rotary drive elements are nestingly mounted for selective rotational movement relative to each other.

The input drive means delivers input torque for driving the output drive sleeve in two different modes of operation; i.e., a wobbling washing mode and a rotary spin or centrifugal extraction mode. For the wobbling mode the axis of rotation of the output drive sleeve which is coaligned with the central axis of the basket is canted relative to the substantially vertical reference axis defined as the axis of rotation of the input drive shaft 72, whereas for the spin mode the axis of the output drive tube and the reference axis are substantially coaligned. The shifting or switching between the two modes is facilitated by a lost motion connection between the input drive means and the intermediate drive shaft, permitting rotary movement of the input drive means relative to the intermediate shaft between a first relative position and a second relative position in which the input drive means is angularly displaced relative to the intermediate by a predetermined angle.

As best seen in FIG. 3, drive tube 74 has formed therein a bore 75 having a longitudinal axis designated Y—Y which extends at an angle to the drive shaft axis designated X—X. Similarly, output drive sleeve 82 has formed therein a bore 83 having a longitudinal axis designated Z—Z extending at an angle to the axis of rotation of the sleeve designated W—W. Bore 83 of sleeve 82 rotatably receives the upper portion 78 of intermediate shaft 76 and the bore 75 of drive tube 74 rotatably receives the lower shaft portion 80 of intermediate shaft 76. The longitudinal axis of upper portion 78 designated I—I and longitudinal axis of lower portion 80, designated J—J, extend at an angle relative to each other intersecting at point A. When assembled, point A lies on the reference axis X—X. The angle between upper and lower portions 78 and 80 and the canting bores 75 and 83 of the drive tube 74 and sleeve 82, respectively, are arranged such that when assembled the angles of inclination of the intermediate shaft portions relative to the reference axis either effectively add, thereby canting the basket as shown in FIG. 2 to provide the desired wobble motion during wash cycles, or effectively cancel, such that the central basket axis is substantially coaligned with the reference axis, as shown in FIG. 1 to permit rotation of the basket about its central axis during spin cycles.

Referring again to FIGS. 1 and 2, the driving means for rotating basket 30 is motor 58 which is drivingly coupled to input drive shaft portion 72 of the input drive means via belt 63 and drive pulley 64.

Figure 2:
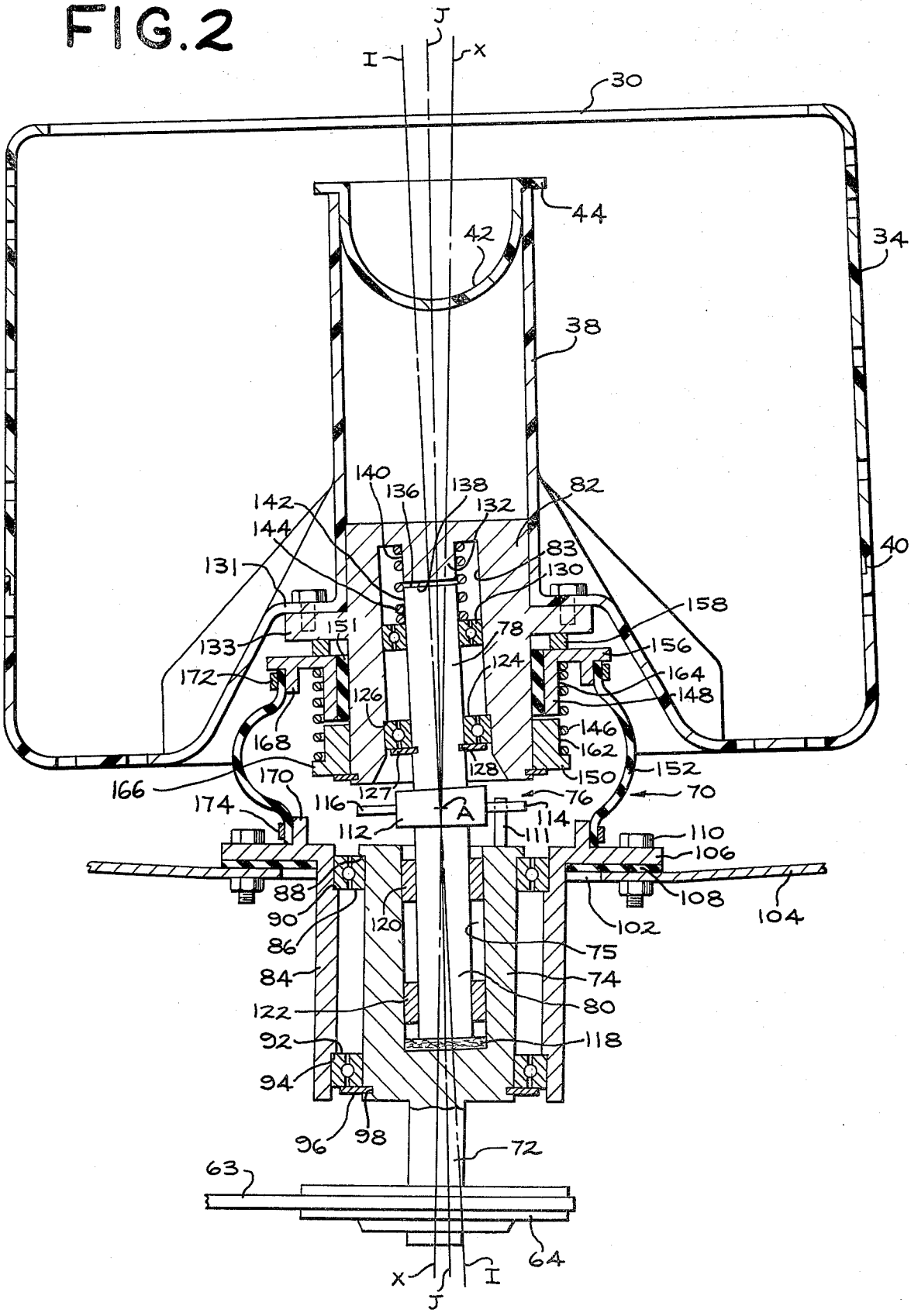
FIG. 2 is an enlarged sectional view of the basket and mounting and driving means of the washing machine of FIG. 1 showing the basket in position for wash.

As best seen in FIG. 2, drive tube portion 74 extending upwardly from drive shaft 72 is rotatably and axially supported in cylindrical housing 84 by ball bearing assembly 86 positioned between radially extending annular flange 88 formed at the upper end of drive tube 74 and annular shoulder 90 formed on the inner periphery of housing 84. Additional rotational support for drive tube 74 is provided by ball bearing assembly 92 positioned between annular shoulder 94 formed on the inner periphery of the lower portion of housing 84 and held in place by snap ring 96 positioned in annular slot 98 formed in the outer periphery of the lower portion of drive tube 74. Housing 84 is supported by tub 28 in opening 102 in the bottom wall 104 of tub 28 by radially extending annular flange 106 which overlays the tub bottom wall 104 adjacent opening 102. Annular gasket 108 is sandwiched between the lower face of flange 106 and tub bottom wall 104 to provide a water tight seal between the tub and the housing. Housing 84 is secured in position by bolts 110 passing through flange 106, gasket 108 and the bottom wall 104 of tub 28.

A driving pin 111 extends upwardly from the upper axial face of drive tube 74. Pin 111 is a part of a lost motion coupling means linking drive tube 74 with intermediate shaft 76 to be described hereinafter.

As previously described, intermediate drive shaft 76 comprises a first or upper drive shaft portion 78 and a second or lower drive shaft portion 80, each having a longitudinal axis extending at an angle to the other. Lower shaft portion 80 is rotatably received in bore 75 of drive tube 74. Lower shaft portion 80 is axially supported in the drive tube 74 by thrust bearing 118 disposed in the base of bore 75. Rotational support for shaft portion 80 is provided by oil-impregnated bearing assemblies 120 and 122 which are press-fit in bore 75.

An annular collar 112 formed intermediate shaft portions 78 and 80 has radially extending therefrom a pair of oppositely disposed drive fingers 114 and 116. Driving pin 111 cooperates with driving fingers 114 and 116 to form the lost motion coupling between input drive shaft 72 and intermediate drive shaft 76. When rotated in a first direction, driving pin 111 drivingly engages finger 114 (FIG. 2). When drive shaft 72 is rotated in the opposite direction, driving pin 111 rotates through a predetermined angle of approximately 180° relative to intermediate shaft 76 before drivingly engaging pin 116 (FIG. 1).

Output drive sleeve 82 is rotatably and axially supported from upper shaft portion 78 of intermediate shaft 76. Rotational and axial support for sleeve 82 is provided by bearing assembly 124 which is fitted between an annular shoulder 126 formed on the inner periphery of sleeve 82 and a snap ring 127 snapped into an annular slot 128 provided near the lower end of upper shaft portion 78 near collar 112. Additional rotational support of the upper shaft in the sleeve is provided by bearing assembly 130 press-fitted to upper shaft portion 78 near its upper end. Basket 30 is secured to sleeve 82, the upper portion of which extends upwardly into the interior of basket center post 38 by bolts passing through flattened portions 131 formed adjacent center post 38 into annular flange 133 extending radially outwardly from sleeve 82 near the mid portion thereof.

Because of the angle of inclination of bore 75 of the drive tube 74 relative to the reference axis, the rotation of tube 74 relative to intermediate shaft 76 changes the angle of inclination of the upper portion 78 of the intermediate shaft relative to the reference axis.

It is this change in angle of inclination of the upper shaft portion 78 which is utilized to cause the angles of inclination of the upper and lower portions of the intermediate shaft relative to the reference axis to add when rotated in the first direction (clockwise looking down on machine of FIG. 1) for wash and to cancel when rotated in the opposite direction for spin, thereby canting the basket relative to the reference axis for wash as shown in FIG. 2 and vertically aligning the basket relative to the reference axis for spin as shown in FIG. 1.

In the illustrative embodiment, the desired cant angle of the basket reference axis relative to the reference axis is on the order of 2°. This is achieved by canting upper shaft portion 78 of intermediate shaft 76 relative to lower shaft portion 80 at an angle of 4° in the direction of the longitudinal axis of driving finger 116. Bore 75 of drive tube 74 must be canted relative to its axis of rotation by an angle of 2° in a radially extending plane longitudinally bisecting drive pin 111. Bore 83 of drive sleeve 82 must be inclined relative to the axis of rotation of sleeve 82 by an angle of 2°. The longitudinal axis of both bores should intersect at point A on the reference axis.

In order to drive basket 30 in the various modes of operation a wound spring type of clutch mechanism (also known in the art as an L.G.S.-clutch mechanism) is employed for selectively coupling the upper portion of the intermediate shaft to the drive sleeve and the drive sleeve to the tub. When the motor rotates in a first direction, the input drive shaft 72 and the intermediate drive shaft 76 rotate while a first clutch mechanism prevents rotation of drive sleeve 82 and basket 30 so that a wobble type motion is imparted to the basket for cleaning the fabrics as the motion of the upper shaft portion described an inverted cone, centered on the reference axis beneath the basket. When the drive motor rotates in the opposite direction, a second clutch mechanism causes drive sleeve 82 to rotate with the intermediate shaft to spin basket 30 for centrifugal extraction of liquid from the fabrics.

A cylindrical stub shaft 132 is formed at the blind end of bore 83 of sleeve 82 coaxially with and extending into the bore. Stub shaft 132 is substantially the same diameter as the upper intermediate shaft portion 78. When assembled, stub shaft 132 and upper portion 78 of the intermediate shaft 76 are axially coaligned with upper axial face 136 of shaft portion 78 closely adjacent lower axial face 138 of stub shaft 132, such that the outer surface 140 of stub 132 and the outer surface 142 of intermediate upper shaft portion 78 are substantially coextensive. Clutch spring 144 is mounted on outer surfaces 140 and 142, to form the first spring clutch mechanism.

Drive sleeve 82 is selectively coupled to tub 28 through a second spring clutch mechanism employing spring 146, clutch collar 148, brake collar 150, boot 152, and housing 84. Drive sleeve 82 is rotatably supported in clutch collar 148 by oil impregnated bearing assembly 151. Brake collar 150 has formed at its upper end an annular outwardly projecting flange 156. An annular water seal member 158 positioned between the upper face of flange 156 and the lower face of annular mounting flange 133 to prevent leakage from the tub into the mounting and driving means. Brake collar 150 is mounted to the outer periphery of the lowermost portion of drive sleeve 82 axially closely adjacent clutch collar 148, with the outer surface 162 of brake collar 150 being substantially coextensive with outer surface 164 of clutch collar 148. Brake collar 150 is secured to drive sleeve 82 by any suitable means such as press-fit. Clutch spring 146 is mounted on surfaces 162 and 164, retained between flange 156 of clutch collar 148 and annular flange 166 extending radially from the lower portion of brake collar 150. Clutch spring 146 is wound in the opposite direction to clutch spring 144.

Clutch collar 148 is flexibly coupled to housing 84 by a resilient waterproof boot 152. A mounting ring 168 projects downwardly from flange 156 of clutch collar 148. A similar oppositely disposed ring 170 projects upwardly from housing 84. Boot 152 is secured at its upper edge to ring 168 and at its lower edge to ring 170 by any suitable means such as by bands 172 and 174, respectively, thereby providing a flexible water tight seal for the mounting means, but also serving to limit the rotation of clutch collar 148. Boot 152 flexes to permit the wobble motion of the basket relative to the tub.

Operation of the first and second clutch mechanism will now be described. When intermediate shaft 76 rotates in a first direction, clutch spring 146 tightens, preventing rotation of brake collar 150 relative to clutch collar 148. Thus, intermediate drive shaft 76 rotates relative to drive sleeve 82. When intermediate shaft 76 rotates in the opposite direction, clutch spring 146 slips, permitting relative rotation between the clutch collar 148 and brake collar 150. However, clutch spring 144 tightens causing stub shaft 132 to rotate with intermediate shaft 76 such that drive sleeve 82 spins with the shaft.

Operation of the drive and mounting means 70 during wash and spin will now be described. During wash, motor 58 rotates in a first direction, clockwise as viewed from above in FIG. 2. Input drive shaft 72 is rotated clockwise by pulley 64 and belt 63. When drive shaft 72 rotates clockwise, drive pin 111 engages drive finger 114 as shown in FIG. 2, thereby rotating intermediate shaft 76 clockwise. Friction between upper shaft portion 78 of intermediate shaft 76 and clutch spring 144 causes clutch spring 144 to expand. Thus, upper shaft portion 78 rotates in the clockwise direction without applying any appreciable torque to drive sleeve 82. Upper shaft portion 78 thus rotates within sleeve bore 83 imparting to the basket a wobble type motion as a result of the bearing friction of the bearing assemblies, the rotation of the shaft portion 78 also causes basket 30 to tend to rotate slowly in the clockwise direction. This precessional or slowly rotating movement of basket 30 is transmitted to brake collar 150 secured to drive sleeve 82. Rotation of clutch collar 148 causes clutch spring 146 to contract so as to firmly seize upon the outer surfaces 162 and 164 of the brake collar 150 and the clutch collar 148, respectively. This occurs because clutch spring 146 is wound in the opposite direction to the clutch spring 144. Clutch spring 146 thus locks brake collar 150 to clutch collar 148 so that rotation of basket 30 relative to tub 28 is prevented. Therefore, basket 30 is effectively held against rotational movement while the intermediate drive shaft rotates within bore 83. When pin 111 engages finger 114, the canting of bores 75 and 83 and the angular orientation of the upper and lower intermediate shaft portions 78 and 80 cause drive sleeve 82 and consequently basket 30 to be canted relative to the reference axis. Thus, rotation of the intermediate shaft within bore 75 causes the movement of the central basket axis to define an inverted cone, thereby imparting a wobble type motion to the basket for washing fabrics contained therein.

When motor 58 rotates drive shaft 72 in the opposite direction for spin, pin 111 engages finger 116 and rotates intermediate shaft 76 therewith. Friction between the upper portion of intermediate shaft 76 and clutch spring 144 causes clutch spring 144 to contract and firmly seize upon the outer surfaces 140 and 142 of shaft stub 132 and upper shaft portion 78, respectively, locking stub shaft 132 and thus the drive sleeve 82 to the upper shaft portion 78 of shaft 76 so that sleeve 82 also rotates with shaft 76. Rotation of sleeve 82 rotates clutch collar 150 relative to clutch collar 148 tending to unwind clutch spring 146 and cause it to slip, permitting drive sleeve 82 and basket 30 to rotate relative to tub 28 to permit centrifugal extraction of liquid from the washing fabrics in basket 30. The initial rotation of drive tube 74 in the opposite direction rotates drive tube 74 relative to intermediate shaft 76 through a predetermined angle of approximately 180° to the position shown in FIG. 1 with drive pin 111 drivingly engaging drive finger 116.

The rotation of drive tube 74 relative to intermediate shaft 76, because of the canting of bore 75 of drive tube 74, alters the inclination of the upper shaft portion 78 of intermediate shaft 76 relative to the reference axis such that the central basket axis is substantially coaxially aligned with the reference axis of the system, and the basket rotates on center about its own axis.

Referring again to FIG. 1, the fluid system for washing machine 10 will now be described. The washing machine is a fresh water, flow through machine. The machine includes water supply means in the form of a solenoid operated mixer valve 178 shown in phantom having solenoids 180 and 182 and coupled to sources of hot and cold water, such as household faucets, through hoses 184 and 186, respectively. For selective energization of the solenoids, hot, cold or warm water will be provided at the output of valve 178. The output of mixer valve 178 is fed through a conduit 188 to a solenoid diverter assembly 190 having a solenoid operated control valve 192. When valve 192 is deenergized or closed, all of the water entering the assembly 190 is fed to hose 194. When valve 192 is energized or open, the flow from assembly 190 is divided between hoses 194 and 196 in a predetermined ratio such as, for example, 4 to 1. Hose 194 is connected to a fill ring 198 which is secured to an annular mounting frame 200 which in turn is suitably mounted to the upper extremity of tub 28. Fill ring 198 is a continuously hollow annular tube having a plurality of apertures 202 formed therein so that water from hose 194 will spray downwardly all around the inside of basket 30. Hose 196 is connected to a fluid nozzle 204 which is fastened to an aperture formed in the cabinet top 16. Nozzle 204 is in juxtaposition to aperture 24 formed in lid 20 to supply water to trough 22. Output from the trough 22 is discharged from the spout 26 into the dispensing receptacle 42 for mixing with the detergent, liquid, or granules which have been placed therein.

The water sprayed from ring 198 wets the load of fabrics in the basket. After the fabrics are wet to a degree that water soaks through, water will pass through the items being washed and thence to the perforations at the bottom of the basket.

A typical clothes washing operation proceeds as follows: The clothes to be washed are placed within the basket and the desired amount of detergent is placed in the receptacle. The operator chooses the appropriate washing cycle, times and water termperatures and turns on the machine. First, there is an initial wetdown or soaking of the fabric articles in the basket by the flow of water from the fill ring without any flow of water from trough 22. This action wets the clothes and prepares them for washing without using any detergent. When the clothes are thoroughly soaked, water will drain through apertures 210 in the basket bottom into sump 53. As water collects in the sump, pressure switch 54 is activated and energizes motor 58 which in turn causes the mounting means to move basket 30 in its washing or wobbling mode. The motor includes a centrifugal switch which closes when the motor starts rotating. Thus, even though the water is pumped from sump 53, thereby resetting pressure switch 54 during the wash operation, the motor will continue to run to continuously remove water from tub 28 throughout the remainder of the wash cycle. Closing of switch 54 also results in the energization of valve 192 so that flow of water is divided between ring 198 and trough 22. The water directed to trough 22 flows from spout 26 into the receptacle 42 where it mixes with detergent in receptacle 42 and due to the motion of the basket is ejected from the receptacle and mixes with the clothing in a diluted form.

At the conclusion of wash, there is a centrifugal extraction of the wash water. To accomplish this, the direction of rotation of motor 58 is reversed. This causes mounting means 70 to align the central axis of the basket 30 with the reference axis of the mounting means to rotate basket 30 at high speed about this axis. The pump removes the centrifuged water from the machine.

The rinse process following the centrifugal extraction of the wash water is very similar to the wash process with wobbling movement of the basket, but often with a change in the water temperature selection. Upon conclusion of the rinse portion of the cycle the flow of water is terminated and the machine enters another centrifugal water extraction or basket spin mode of operation such as described above.

Of course, more than one washing and/or rinsing operation may be provided, if so desired.

It is apparent from the foregoing that the present invention provides an improved wobble type fabric washing appliance employing a simplified mounting means which provides the necessary wobble motion of the basket during wash and centers the basket for rotation about its own axis during spin. While a specific embodiment of the invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A washing appliance for fabric articles of the type utilizing a wobbling action to wash the fabric articles, said washing appliance comprising:

a generally upright basket for receiving washing liquid and a fabric article load to be washed in the liquid, said basket having a longitudinal central axis;

mounting means connected to said basket for movably supporting and selectively driving said basket; said mounting means including input drive shaft means, the longitudinal axis of said input drive shaft means defining a substantially vertical reference axis for said mounting means;

driving means for selectively rotating said input drive shaft means in a first direction to provide a wash periods of operation and a second direction to provide a spin period of operation;

said mounting means being constructed and arranged to cant the central axis of said basket relative to the reference axis when said input shaft is rotated in its first direction and to move the central axis to substantially vertically coalign the central axis of said basket and the reference axis thereby eliminating said cant when said input shaft rotates in its second direction whereby said basket is canted relative to the vertical during wash periods to provide wobbling motion of said basket and substantially vertically aligned during spin periods to permit said basket to rotate on center during spin.

2. The washing appliance of claim 1 wherein said mounting means further comprises:

a drive sleeve drivingly connected to said basket;

intermediate drive shaft means selectively drivingly connected to said drive sleeve; and lost motion coupling means drivingly coupling said input drive shaft means and said intermediate drive shaft means so as to permit limited relative rotational motion of said intermediate drive shaft means and said input drive shaft means between a first relative position and a second relative position; said intermediate drive shaft means and said input drive shaft means assuming the first and second relative positions when said input shaft is rotated in its first and opposite directions respectively;

said input drive shaft means, intermediate drive shaft means and drive sleeve cooperating to cant said basket relative to the reference axis when said intermediate drive shaft means and input drive shaft means are in the first relative position and to substantially co-align the basket central axis with the reference axis when in the second relative position.

3. The washing appliance of claim 2 wherein said input drive shaft means includes a drive tube portion having formed therein a tube bore having a longitudinal axis extending at an angle relative to the reference axis;

said drive sleeve has formed therein a sleeve bore having a longitudinal axis extending at an angle relative to the central axis of said basket;

said intermediate drive shaft means comprises a first shaft portion rotatably received in said tube bore and a second shaft portion rigidly projecting at an angle relative to said first shaft portion and rotatably received in said sleeve bore; and the relative angular orientations of said tube bore, said sleeve bore and said first and second shaft members being selected such that when said intermediate drive shaft means and said input drive shaft means are in the first relative position, the central axis of said basket is canted relative to the reference axis and when said intermediate drive shaft means and input drive shaft means are in the second relative position the central axis of said basket is substantially aligned with the reference axis.

4. The washing appliance of claim 2 or 3 further comprising:

first coupling means for selectively drivingly connecting said intermediate drive shaft means to said drive sleeve, operative to permit rotation of said intermediate drive shaft means relative to said sleeve when said intermediate drive shaft means rotates in the first direction and to rotate said sleeve in concert with said drive intermediate shaft means when said intermediate drive shaft means is rotated in the opposite direction; and second coupling means for preventing rotation of said sleeve about its axis when said intermediate drive shaft means rotates in the first direction and enabling rotation of said sleeve about its axis when said intermediate drive shaft means rotates in the opposite direction;

whereby said basket is prevented from rotation about its central axis during wash periods and is enabled to rotate about its central axis during spin periods.

5. The washing appliance of claim 4 wherein said intermediate drive shaft means further comprises a central portion joining said first and second shaft portions and said lost motion coupling means comprises first and second drive members rigidly radially extending from said central portion, arcuately spaced apart by a predetermined angle, and a driving member projecting from said drive tube for driving engagement with said first and second drive members when said input shaft means rotates in its first and opposite directions respectively.

6. The washing appliance of claim 3 wherein the longitudinal axes of said first and second shaft members and the reference axis intersect at a common point.

7. A washing appliance for fabric articles, said washing appliance comprising:

a generally upright basket for receiving washing liquid and a fabric article load, said basket having a central axis;

mounting means connected to said basket for supporting and selectively driving said basket;

driving means drivingly connected to said mounting means for moving said basket;

said mounting means comprising:

an input drive tube drivingly connected to said driving means for rotation in a first direction to provide wash periods and in the opposite direction to provide a spin periods, the axis of rotation of said tube defining a substantially vertical reference axis, said tube having formed therein a cylindrical tube bore having longitudinal axis extending at an angle relative to the reference axis;

an output drive sleeve drivingly connected to said basket for selectively rotating said basket about its central axis, said sleeve having formed therein a cylindrical sleeve bore having an axis extending at an angle to said central basket axis;

a rigid drive shaft comprising a first shaft portion rotatably received in said tube bore and a second shaft portion canted relative to said first shaft portion rotatably received in said sleeve bore;

lost motion coupling means drivingly connecting said intermediate drive shaft and said input drive tube so as to permit said tube to rotate between a first position relative to said intermediate drive shaft and second position relative to said intermediate drive shaft angularly displaced from the first position, said tube being placed in its first position by rotation of said tube in the first direction and in its second position by rotation of said tube in the opposite direction;

said tube, sleeve and intermediate drive shaft being constructed and arranged such that when said tube is in its first position, the central axis of said basket is canted relative to the reference axis and when in its second position the central axis is essentially co-aligned with the reference axis whereby during wash periods said basket is canted relative to the vertical and during spin periods said basket is substantially vertically aligned.

8. The washing appliance of claim 7 wherein said mounting means further comprises means for preventing rotation of said sleeve about the central basket axis when said drive tube rotates said intermediate drive shaft means in the first direction; and means selectively drivingly connecting said sleeve and said intermediate drive shaft means for rotation therewith when said drive tube rotates said intermediate shaft in the opposite direction.

9. In an automatic washing machine for washing fabric articles of the type including a basket having central axis to receive liquid and fabric articles to be washed in the liquid, wash means for effecting washing of the fabric articles, an input drive shaft the longitudinal axis of which defines a substantially vertical reference axis, drive means for selectively rotating the basket in first and second directions to produce a wash period of operation and a spin period of operation respectively, improved mounting means for supporting and selectively driving the basket, said mounting means comprising:

a drive tube drivingly connected to the input drive shaft, said drive tube having formed therein a tube bore having a longitudinal axis extending at an angle angle relative to the reference axis of the input drive shaft;

an output drive sleeve secured to the basket having a sleeve bore formed therein having a longitudinal axis extending at an angle relative to the central basket axis;

a rigid intermediate drive shaft comprising a first shaft portion and a second shaft portion, said second shaft portion being canted relative to said first shaft portion, said first shaft portion being rotatably received in said tube bore and said second shaft portion being rotatably received in said sleeve bore;

lost motion coupling means drivingly connecting said drive tube and said intermediate drive shaft, permitting said drive tube to rotate through a predetermined angle relative to said intermediate drive shaft between a first position relative to said intermediate drive shaft and a second position relative to said intermediate drive shaft, said drive tube being moved to its first and second positions by rotation of said input drive shaft in its first and second directions respectively;

the tube bore, the sleeve bore and the relative cant of said first and second shaft portions being aligned such that when said drive tube is in its first position the central basket axis is canted relative to the reference axis and when said drive tube is in its second position the central basket axis is substantially coaligned with the reference axis whereby during wash operations the basket is canted and during spin the basket is vertically aligned.

* * * * *